United States Patent [19]

Kauter

[11] 4,073,149

[45] Feb. 14, 1978

[54] MINE ROOF SUPPORT ASSEMBLIES

[75] Inventor: Hans Kauter, Lunen, Germany

[73] Assignee: Gewerkschaft Eisenhutte Westfalia, Wethmar bei Lunen, Germany

[21] Appl. No.: 637,329

[22] Filed: Dec. 3, 1975

[30] Foreign Application Priority Data

Dec. 18, 1974 Germany ..... 2459792

[51] Int. Cl.[2] ..... E21D 15/44

[52] U.S. Cl. ..... 61/45 D

[58] Field of Search ..... 61/45 D; 248/357; 299/32, 31

[56] References Cited

U.S. PATENT DOCUMENTS

| | | | |
|---|---|---|---|
| 3,830,070 | 8/1974 | Rosenberg et al. | 61/45 D |
| 3,885,376 | 5/1975 | Snowden et al. | 61/45 D |
| 3,898,845 | 8/1975 | Plevak et al. | 61/45 D |
| 3,932,998 | 1/1976 | Lubojatsky et al. | 61/45 D |

FOREIGN PATENT DOCUMENTS

| | | | |
|---|---|---|---|
| 1,358,541 | 7/1974 | United Kingdom | 61/45 D |

*Primary Examiner*—Jacob Shapiro

*Attorney, Agent, or Firm*—Thompson, Birch, Gauthier & Samuels

[57] ABSTRACT

A mine roof support assembly which has a stowage or goaf screen lining pivoted to a floor-engaging sill structure and a piston and cylinder unit arranged between the sill structure and the screen to effect pivoting of the screen. A roof bar is pivotably connected to a bell-crank lever which is itself pivoted to the screen and a stiff rod is pivotably connected to the bell-crank lever and to the sill structure. The rod and bell-crank lever form a control linkage which exerts a compensating effect on the roof bar as the screen is pivoted to move the bar against or away from the roof, so that the bar maintains in horizontal orientation while the front end of the bar moves along a vertical line.

5 Claims, 1 Drawing Figure

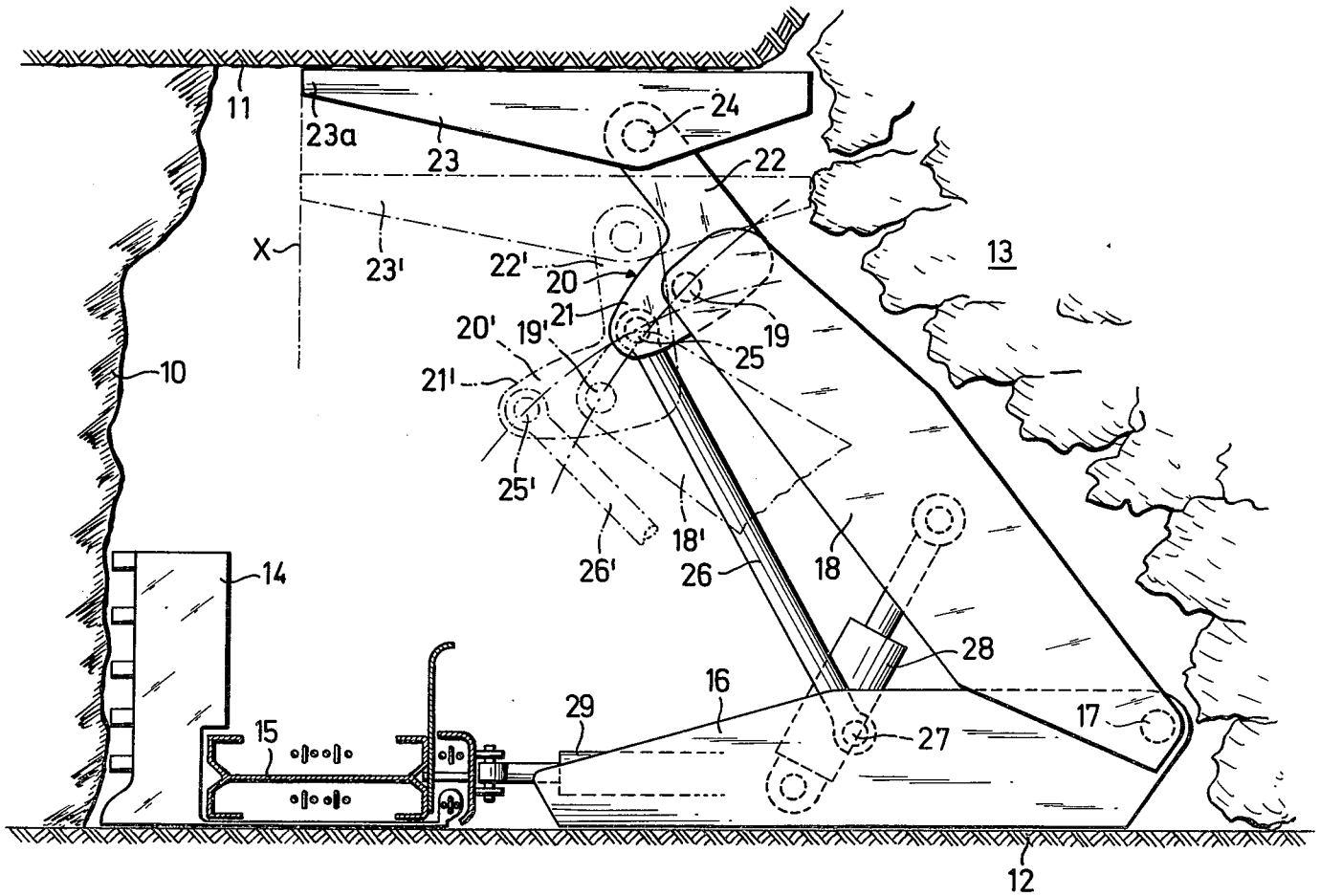
10
11
12
13
14
15
16
17
18
18'
19
19'
20
20'
21
21'
22
22'
23
23'
23a
24
25
25'
26
26'
27
28
29
X

MINE ROOF SUPPORT ASSEMBLIES

BACKGROUND OF THE INVENTION

The present invention relates to mineral mining installations and more particularly to roof support assemblies usable in such installations.

In mine workings, and especially in coal mine workings, it is well known to provide a longwall scraper-chain conveyor which transports material detached from a mineral face by a machine, such as a plough, guided on the conveyor. Roof support assemblies are then arranged on the side of the conveyor remote from the mineral face. These assemblies are connected to the conveyor through shifting rams which serve, individually, to selectively advance the assembly or a portion of the conveyor up towards the face as the mineral winning progresses. Roof support assemblies are known in a variety of constructions and the present invention is concerned with assemblies of the type which employ a stowage or goaf shield lining which screens off the waste or fracture in the stowage zone caused by the partial collapse of the roof as the longwall moves up. In all forms of roof support assembly the actual support of the roof over the working is effected by one or more roof bars and it is desirable for these bars to extend right up to the face as far as possible. In certain known roof support assemblies which employ stowage shields the front end of the or each roof bar tends to move towards the face as the bar is lowered. Consequently, when the bar is set against the roof there must always be unsupported space between its front end and the roof part of the face to accommodate this movement. In order to overcome this problem it is known to provide a composite or multi-part screen and a compensating piston and cylinder unit which serves to bring the roof bar or bars towards the face when the bar or bars is being raised. An alternative construction has a multi-part roof bar which has an outer portion which can be moved towards and away from the face by means of a hydraulic piston and cylinder unit and locked in position. Both these constructions necessitate extra equipment and hence expense and can be disabledby jamming when waste material lodges in gaps.

It is also known to provide a system of guide or control rods which combine with a multi-part screen and ensure that the front end of the or each roof bar moves along a vertical line parallel to the mineral face. See for example Japanese patent publication 547032. This construction is better from the point of view of disablement but again extra expense is involved because of the special design. Moreover, an assembly of this type takes up considerable space in the mine working.

A general object of the present invention is to provide an improved form of support assembly.

SUMMARY OF THE INVENTION

In one aspect the invention provides a mine roof support assembly which has a stowage shield pivotably connected to a floor sill structure, which, during use, rests on the floor of a mine working, means for pivoting the shield in relation to the floor sill structure, a roof bar which is raised or lowered in relation to the roof of the mine working when the shield is pivoted during use and control means connected between the roof bar, the shield and the floor sill to ensure that a front end of the roof bar moves along a substantially vertical line when the shield is pivoted.

In another aspect the invention provides a mine roof support assembly which has a stowage shield, a floor sill structure for engaging on the floor of a mine working, means pivotably interconnecting the floor sill structure to the shield, means for pivoting the shield in relation to the floor sill structure, a roof bar for engaging the roof of the mine working and a mechanical linkage pivotably connected to the roof bar, to the shield and to the floor sill structure, the mechanical linkage serving to control the position of the roof bar as the shield is pivoted in relation to the floor sill in a manner such that the roof bar maintains its orientation in relation to the floor sill with a front end of the roof bar remote from the shield moving along a substantially vertical line.

In contrast to certain known designs the shield of an assembly made in accordance with the invention can be of conventional unitary form with a main wall and side walls and the assembly can be constructionally simple yet robust and reliable.

The mechanical linkage of control system preferably comprise a first element pivoted to the roof bar and to the shield and a second element pivotably connected to the first element and to the floor sill structure. The first element is preferably a non-rectilinear lever such as a bell-crank lever or toggle whereas the second element is preferably a rectilinear lever such as a rod or bar which is rigid or stiff. The first element can then have an upper limb pivoted at or near its end to the roof bar and a lower limb pivoted at or near its end to the rod. The shield is then pivoted to the lower limb of the bell-crank lever intermediate its end and the juncture with the upper limb.

The means for pivoting the shield to thereby raise or lower the roof bar is preferably a hydraulic piston and cylinder unit coupled between the floor sill structure and the shield and arranged in an inclined position. As this hydraulic unit retracts to lower the roof bar the bell-crank lever pivots away from the mineral face to compensate for the motion of the shield towards the face. By choosing suitable design parameters, e.g., the length of the rod and the limbs of the bell-crank lever, it can be arranged that the front end of the roof bar moves along a straight line as the hydraulic unit retracts or extends. Thus, the front end of the bar can be brought right up to the face as is desired to ensure adequate support.

All the components of an assembly made in accordance with the invention can be readily accessible and no unnecessary space is taken up. Since it can be arranged that the roof bar does not generally change its orientation as the shield is pivoted, any gap between the rear end of the roof bar and the upper part of the shield does not change in size, in contrast to certain known designs. In these known designs the gap decreases as the roof bar is lowered so that material in the gap initially will be compressed by the wedging action of the rear end of the roof bar. With an assembly of this invention there is now less likelihood of jamming when material in the stowage zone enters into the gap.

The invention may be understood more readily and various other features of the invention may become apparent, from consideration of the following description.

BRIEF DESCRIPTION OF DRAWING

An embodiment of the invention will now be described, by way of example only, with reference to the accompanying drawing, which is a schematic side view of a mineral installation employing a support assembly made in accordance with the invention.

DESCRIPTION OF PREFERRED EMBODIMENT

As shown in the drawing, a mineral mining installation is arranged in a mine working which has a longwall mineral face 10, e.g., a coal seam, a roof 11 and a floor 12. Material is detached from the face 10 by means of a winning machine 14 such as a plough guided for movement along a longwall scraper-chain conveyor 15. This conveyor is composed in known manner of a series of channel sections arranged end-to-end and a scraper-chain assembly circulated along these sections to transfer material detached by the machine 14. The machine 14 as here illustrated, employs a sword plate extending beneath the conveyor channel sections and connected to a drive chain circulated within guide channels provided at the stowage or goaf side of the conveyor. Barrier plates, known per se, are also provided at the goaf side of the conveyor channel sections.

Between the goaf or stowage zone of the working, generally denoted 13, and the conveyor 14 is disposed an assembly made in accordance with the invention. The construction of this assembly will now be described. The assembly has a floor sill structure 16 which may be a simple base plate or of composite form as illustrated including side walls and a base. In known manner, a hydraulic ram 29 is connected between the floor sill 16 and the conveyor 15. More particularly, the ram 29 has a piston rod articulated with a vertical pivot pin to one of the covers defining the chain guide channels on the goaf side of the conveyor 15. This ram 29 serves, as is known, to alternately advance a local part of the conveyor 15 and the assembly towards the mineral face 10. A stowage or goaf shield 18 which may have a main wall and side walls as shown is pivotably connected to the floor sill 16 at the rear zone of the latter with the aid of a pivot joint 17. At the upper part of the shield 18 there is disposed a first control or guide element 20 in the form of a bell-crank lever. The lever 20 is pivotably connected to the shield 18 with the aid of a pivot joint 19 arranged with its axis passing through the lower limb 21 of the lever 20. A roof bar or girder 23 intended to engage on the roof 11 is pivotably connected to the end of the upper limb 22 of the lever 20 by means of a pivot joint 24. A second guide or control element in the form of a rod 26 which is flexurally resistant, i.e., rigid or stiff, is pivotally connected at its upper end to the end of the lower limb 21 of the lever 20 with the aid of a pivot joint 25 and as its lower end to the floor sill 16 with the aid of a pivot joint 27. A double-acting hydraulic piston and cylinder unit 28 is disposed in an inclined position as shown and connected via further pivot joints to the shield 18 and to the floor sill 16. The axes of the various pivot joints mentioned above all extend parallel to one another and are generally parallel to the conveyor 15.

With the unit 28 extended the components of the assembly take the position as illustrated with the roof bar 23 urged against the roof 11 and the shield 18 serves to screen off the stowage zone 13. The rod 26 maintains the lever 20 in a position such that the bar 23 is substantially horizontal as shown. If now the unit 28 is retracted the shield 18 pivots about the joint 17. The rod 26 now urges the lever 20 about the joint 19 in a clockwise direction so that as the shield 18 moves towards the floor sill 16 the joints 19, 25 move towards the stowage zone 13. By appropriate design it can be arranged that the control means or linkage 20, 26 maintains the horizontal disposition of the roof bar 24 while the unit 28 retracts so that the front end 23a of the roof bar 24 moves along a vertical line X. The position of the components during retraction of the unit 28 is represented by chain-dotted lines and by prime suffixes added to the reference numerals.

Although not shown in the drawing the front end 23a of the roof bar 23 can be made to abut against the roof part of the face 10 to provide adequate support during the mineral winning process.

Although only one assembly is shown in the drawing it would be expected that several assemblies would be provided along the working so that the conveyor 15 can be advanced over portions of its length, to perform the so-called "snaking" advance, with the aid of the rams 29. Where a continuous screen for the stowage zone 13 is desired the shield 18 of the assemblies may engage one another or lie closely adjacent to one another.

I claim:

1. A mine roof support assembly comprising: a stowage shield; a floor sill structure for resting on the floor of a mine working; means for pivotably connecting said stowage shield to said floor sill structure; a hydraulic piston and cylinder unit connected between said stowage shield and said floor sill structure and serving to pivot said stowage shield in relation to said floor sill structure, said unit being arranged in an inclined position; a roof bar engageable on the roof of the mine working and displaceable in relation to the roof when said stowage shield is pivoted; and mechanical linkage means interposed between said roof bar and both said stowage shield and said floor sill structure for ensuring that a front end of said roof bar remote from said shield moves along a substantially vertical line when said shield is pivoted.

2. A mine roof support assembly comprising: a stowage shield; a floor sill structure for resting on the floor of a mine working; means for pivotably connecting said stowage shield to said floor sill structure; means for pivoting said stowage shield in relation to said floor sill structure; a roof bar engageable on the roof of the mine working and displaceable in relation to the roof when said stowage shield is pivoted; and a mechanical linkage connected between said roof bar, said stowage shield and said floor sill structure for ensuring that a front end of said roof bar remote from said stowage shield moves along a substantially vertical line when said stowage shield is pivoted, said mechanical linkage comprising a bell-crank lever and a rod, said rod being pivotably connected to said floor sill structure and the bell-crank lever having an upper limb pivoted at its end to the roof bar and a lower limb pivoted at its end to said rod with said stowage shield being pivoted to the lower limb of said bell-crank lever intermediate its end and the juncture with the upper limb.

3. A mine roof support assembly comprising: a stowage shield; a floor sill structure for resting on the floor of a mine working; means for pivotably connecting said stowage shield to said floor sill structure; means for pivoting said stowage shield in relation to said floor sill structure; a roof bar engageable on the roof of the mine working and displaceable in relation to the roof when said stowage shield is pivoted; and a mechanical linkage connected between said roof bar, said stowage shield and said floor sill structure for ensuring that a front end of said roof bar remote from said stowage shield moves along a substantially vertical line when said stowage shield is pivoted, said mechanical linkage comprising a bell-crank lever and a rod, said bell-crank lever being pivotably connected to said roof bar, to said stowage shield and to said rod and said rod being pivotably connected to said floor sill structure at a position spaced from the pivot connection between said stowage shield and said floor sill structure and in a direction towards the front end of said roof bar.

4. In a mineral mining installation comprising a long-wall scraper-chain conveyor arranged alongside a mineral face in a mine working, a winning machine movable along the conveyor, a mine roof support assembly adapted to be disposed on the side of the conveyor remote from the mineral face, said assembly comprising: a stowage shield; a floor sill structure resting on the floor of the mine working; means for pivotably connecting said stowage shield to said floor sill structure; a hydraulic piston and cylinder unit connected between said stowage shield and said floor sill structure and arranged in an inclined position, said unit being operable to pivot said stowage shield in relation to said floor sill structure; a roof bar engageable on the roof of the mine working a displaceable in relation to said roof when said stowage shield is pivoted; mechanical linkage means interposed between said roof bar and both said stowage shield and said floor sill structure for ensuring that a front end of said roof bar adjacent the mineral face moves along a substantially vertical line when said stowage shield is pivoted; and a shifting ram for coupling the conveyor to the floor sill structure.

5. The assembly as claimed in claim 1 wherein said mechanical linkage means controls the position of said roof bar so that said roof bar maintains its orientation in relation to said floor sill structure as said stowage shield is pivoted.

* * * * *